US009256172B2

(12) United States Patent
Hasegawa

(10) Patent No.: US 9,256,172 B2
(45) Date of Patent: Feb. 9, 2016

(54) FIXING DEVICE AND IMAGE FORMING APPARATUS INCLUDING SAME

(71) Applicant: Kenichi Hasegawa, Kanagawa (JP)

(72) Inventor: Kenichi Hasegawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/184,318

(22) Filed: Feb. 19, 2014

(65) Prior Publication Data

US 2014/0239575 A1 Aug. 28, 2014

(30) Foreign Application Priority Data

Feb. 26, 2013 (JP) ..... 2013-035611

(51) Int. Cl.

| | |
|---|---|
| ***B65H 29/54*** | (2006.01) |
| ***G03G 15/20*** | (2006.01) |
| ***G03G 15/00*** | (2006.01) |
| ***B65H 29/56*** | (2006.01) |

(52) U.S. Cl.

CPC ..... *G03G 15/2028* (2013.01); *B65H 29/54* (2013.01); *B65H 29/56* (2013.01); *G03G 15/6532* (2013.01); *G03G 2215/2032* (2013.01)

(58) Field of Classification Search

CPC .... G03G 15/6532; B65H 29/56; B65H 29/54; B65H 29/6609; B65H 29/68

USPC ..... 271/272, 275, 307, 308, 311–313

See application file for complete search history.

(56) References Cited

U.S. PATENT DOCUMENTS 5,589,925 A * 12/1996 Cahill ..... G03G 15/2028 271/307
5,997,965 A * 12/1999 Shimazu ..... C08K 3/32 271/307

(Continued)

FOREIGN PATENT DOCUMENTS

| | | |
|---|---|---|
| JP | 2004-239926 | 8/2004 |
| JP | 2002-311741 | 10/2005 |
| JP | 2006-308978 | 11/2006 |

(Continued)

OTHER PUBLICATIONS www.bing.com, definition of the term "bent".*

(Continued)

*Primary Examiner* — Prasad Gokhale

(57) ABSTRACT

A fixing device includes two rotary bodies and a recording-medium separation unit. The two rotary bodies are pressed against each other to form a nipping portion. The recording-medium separation unit is disposed at a position downstream from the nipping portion in a direction in which the recording medium is conveyed. The recording-medium separation unit includes a separation plate holder, a separation plate, and a spring. The separation plate holder extends in a longitudinal direction of one of the rotary bodies to hold the separation plate away from the one of the rotary bodies. The separation plate holder has rotation fulcrums and positioning surfaces at both ends in the longitudinal direction. The positioning surfaces are urged by the spring toward the one of the rotary bodies. Each of the positioning surfaces has a bent side to form a flange surface having one of the rotation fulcrums.

15 Claims, 6 Drawing Sheets

(56) References Cited

U.S. PATENT DOCUMENTS

| | | | | |
|---|---|---|---|---|
| 6,453,128 | B2 * | 9/2002 | Park | G03G 15/6532 271/312 |
| 6,658,229 | B2 * | 12/2003 | Ando | G60K 15/16 217/311 |
| 2004/0178573 | A1 | 9/2004 | Hasegawa | |
| 2009/0003897 | A1 * | 1/2009 | Yamada | G03G 15/2028 399/323 |
| 2012/0051805 | A1 * | 3/2012 | Suzuki | G03G 15/2028 399/323 |
| 2013/0294802 | A1 * | 11/2013 | Yamamoto | G03G 15/2028 399/323 |

FOREIGN PATENT DOCUMENTS

| | | |
|---|---|---|
| JP | 2009-031759 | 2/2009 |
| JP | 2010-079219 | 4/2010 |
| JP | 2011-064763 | 3/2011 |
| JP | 2011-180344 | 9/2011 |
| JP | 2012-042853 | 3/2012 |

OTHER PUBLICATIONS www.oxforddictionaries.com, definition of the term “bend”.*

* cited by examiner

FIXING DEVICE AND IMAGE FORMING APPARATUS INCLUDING SAME

CROSS-REFERENCE TO RELATED APPLICATIONS

This patent application is based on and claims priority pursuant to 35 U.S.C. §119 to Japanese Patent Application No. 2013-035611, filed on Feb. 26, 2013, in the Japan Patent Office, the entire disclosure of which is hereby incorporated by reference herein.

BACKGROUND

1. Technical Field

Exemplary aspects of the present invention relate to a fixing device for fixing an image with heat and pressure on a recording material conveyed from an upstream side of a nipping portion formed between two rotary bodies pressing against each other, and more particularly, to a recording medium separation configuration of the fixing device. Exemplary aspects of the present invention also relate to an image forming apparatus including the fixing device.

2. Description of the Related Art

Image forming apparatuses are used as, for example, copiers, printers, and facsimile machines employing electrophotographic techniques, or multifunction peripherals having at least one of copying, printing, and facsimile functions. Such electrophotographic image forming apparatuses may employ a heat fixing device. Such a heat fixing device fixes a toner image on a recording medium by fusing and pressing the toner image transferred to the recording medium. The heat fixing device allows the recording medium to pass a nipping portion formed between a heating rotary body heated by a heat source and a pressure rotary body pressing against the heating rotary body, so that the toner image is fixed on the recording medium.

When toner is fused, the toner becomes adhesive. The adhesiveness of the toner may cause a recording medium bearing a toner image to be wound around the heating rotary body. Thus, an outer surface of the heating rotary body includes a release layer made of a material, such as fluorine resin and silicone rubber, as a surface layer. The release layer prevents the recording medium bearing the toner image from winding around the heating rotary body due to the adhesiveness of toner.

Moreover, a separation unit including a separation pawl is attached adjacent to the heating rotary body to forcibly separate the recording medium, which tends to be wound around the heating rotary body due to the fused toner, from the heating rotary body. FIG. 8 is a partial view of one example of such a separation unit. A separation member 5 serving as a separation unit is arranged on a downstream side of a heat fixing device 1 in a recording medium conveyance direction. The heat fixing device 1 includes a heating roller 2 heated by a heater and a pressure roller 3 disposed opposite to the heating roller 2. The separation member 5 is made of heat-resistant resin and rotatably supported around a fulcrum 5*b*. The separation member 5 includes a separation pawl 5*a* extending near an exit of a nipping portion formed between the heating roller 2 and the pressure roller 3 pressing against each other. A spring 4 applies pressure to the separation pawl 5*a* such that the separation pawl 5*a* contacts the heating roller 2. The separation pawl 5*a* is coated with fluorine resin to prevent abrasion caused by contact with the heating roller 2. The separation pawl 5*a* has a pawl width of approximately 2 mm to approximately 10 mm, and a plurality of separation pawls 5*a* are arranged within a sheet-passing area.

Since the separation pawl 5*a* is in contact with the heating roller 2, a portion of the separation pawl 5*a* contacting the heating roller 2 is abraded. Such abrasion may cause abrasion damage to a toner image. Moreover, the separation pawl 5*a* has a tip having an angle limit of approximately 20 degrees in manufacturing, causing difficulty in arranging the tip of the separation pawl 5*a* nearer to the exit of the nipping portion. A leading edge of a recording medium is likely to be wound around the heating roller 2 while being conveyed from the exit of the nipping portion to the tip of the separation pawl 5*a*. Thus, the longer the distance between the exit of the nipping portion and the tip of the separation pawl 5*a*, the more likely an excess amount of heat is to be applied to an image on the leading edge of the recording medium. Consequently, the excess amount of heat may cause generation of an irregular image.

Hence, as illustrated in FIG. 9, a separation plate 6 serving as a separation member may be employed. The separation plate 6 includes a metal plate frame 6*a* having a rotation fulcrum 6*d*, a contact member 6*b* made of heat-resistant resin, and a thin plate 6*c* having a thickness of approximately 0.3 mm. The thin plate 6*c* connects the metal plate frame 6*a* and the contact member 6*b*. A spring 4 applies pressure such that the thin plate 6*c* contacts a heating roller 2. The thin plate 6*c* extends across an entire sheet-passing area, and the contact member 6*b* adjusts a clearance between the heating roller 2 and the thin plate 6*c* such that the clearance becomes approximately 0.5 mm. The separation plate 6 includes projected members arranged on both ends thereof in a longitudinal direction (a direction perpendicular to a sheet surface), and a position of the separation plate 6 is adjusted and fixed by a jig, for example. The clearance between the heating roller 2 and the thin plate 6*c* is changed by adjusting the position of the separation plate 6, whereas the clearance is determined by fixing the position of the separation plate 6. The thin plate 6*c* has a leading edge that is arranged near an exit of the nipping portion. Thus, the separation plate 6 reliably separates a recording medium from the heating roller 2 before the recording medium is wound around the heating roller 2 if the recording medium has a few-millimeter blank (an outer margin) in a leading edge thereof. Since the thin plate 6*c* rubs against the recording medium, a surface of the thin plate 6*c* is coated with fluorine resin, thereby preventing adhesion of toner to the thin plate 6*c*.

The thin plate 6*c* of the separation plate 6 is arranged near the exit of the nipping portion, but not in contact with the heating roller 2. Such an arrangement of the thin plate 6*c* can prevent the problem of the separation pawl in the configuration described with reference to FIG. 8. Moreover, a configuration of enabling adjustment of the clearance is proposed for such a separation plate 6. The proposed configuration enables the clearance to be adjusted during assembly, so that the clearance can be narrower.

Alternatively, JP-2010-079219-A proposes an arrangement of a leading edge of a separation member in a non-contact state to a position where the separation member can maintain separability which is substantially the same as or better than that of the above-described separation pawl. Such an arrangement is made in response to fluctuations of a rotary-body surface in the immediate vicinity on a downstream side of a nipping portion such that the leading edge of the separation member can be disposed in the immediate vicinity on the downstream side of the nipping portion and adjacent to the rotary-body surface. According to this configuration, a separation plate holder 8 as partially illustrated in FIG. 10 is arranged with a separation plate and a guide member. The separation plate holder 8 is a metal plate. Such a separation plate holder 8 holds the separation member such that the height of the separation member is adjustable in a screw tightening direction perpendicular to a recording medium conveyance direction by a spring and a screw.

In the separation plate holder 8, both ends of a base body (both ends of the holder in a longitudinal direction) are bent at a right angle to provide flange surfaces 8', and rotation fulcrum pins 9 are swaged to the respective flange surfaces 8'. The separation plate holder 8 has a side along the longitudinal direction thereof. The side is also bent at a right angle, and both ends thereof are further bent at a right angle to serve as positioning surfaces 8" to which positioning members can be fastened.

The separation plate holder 8 rotates around the rotation fulcrum pins 9, and the positioning members contact a fixing member that is a fixing roller or a fixing belt, so that the separation plate holder 8 is positioned with the fixing member. Since the separation plate is adjustably held with respect to the separation plate holder 8, a clearance with respect to the fixing member can be adjusted by the separation plate, thereby obtaining a narrower clearance. If the clearance is narrower, there is an advantage that the separation plate can more readily separate a recording medium from the fixing member. The separation plate can separate even a thin recording medium from the fixing member. If the clearance is wider, on the other hand, the recording medium can slip into the clearance more easily, causing an increase in the likelihood of recording medium jams. Thus, the clearance is preferably set as narrow as possible.

In such a separation unit, positional accuracy of a rotation fulcrum and a positioning surface of the separation plate holder is important. The rotation fulcrums and the positioning surfaces are arranged on both sides of the separation plate holder in a longitudinal direction (a rotation axis direction). However, in a case where the positional accuracy of these members is not good, only one of the positioning surfaces contacts the fixing member, causing the separation plate holder to be poorly positioned with respect to the fixing member.

In the holder configuration as illustrated in FIG. 10, however, since three bending processes need to be performed when an area from the flange surface for the rotation fulcrum to the positioning surface is formed, the positional accuracy of each of the members is difficult to obtain. Moreover, in a case where such a separation plate holder is used in an actual device, the separation plate might be easily deformed by an external force due to a small dimension of a bent portion thereof that has a dimension of approximately 10 mm.

If a recording medium is jammed and stuck in an accordion shape in the vicinity of the separation plate (the separation member), there are cases where a load is generated to the separation plate holder through the separation plate, and a bending portion of the separation plate holder is deformed. In such cases, the deformed separation plate holder cannot be positioned in a target position with respect to the fixing member, causing a change in the clearance of the separation plate. Consequently, the separation plate may damage the fixing member by interfering with the fixing member, or cannot separate the recording medium from the fixing member due to a wider clearance.

BRIEF SUMMARY

In at least one embodiment of this disclosure, there is provided a fixing device including two rotary bodies and a recording-medium separation unit. The two rotary bodies are pressed against each other to form a nipping portion through which a recording medium is conveyed. The recording-medium separation unit is disposed at a position downstream from the nipping portion in a recording-medium conveyance direction in which the recording medium is conveyed. The recording-medium separation unit includes a separation plate holder, a separation plate, and a spring. The separation plate holder extends in a longitudinal direction of one of the rotary bodies to hold the separation plate away from the one of the rotary bodies. The separation plate holder has rotation fulcrums and positioning surfaces at both ends in the longitudinal direction. The positioning surfaces of the separation plate holder are urged by the spring toward the one of the rotary bodies. Each of the positioning surfaces has a bent side to form a flange surface having one of the rotation fulcrums.

In at least one embodiment of this disclosure, there is provided an image forming apparatus including the above-described fixing device.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
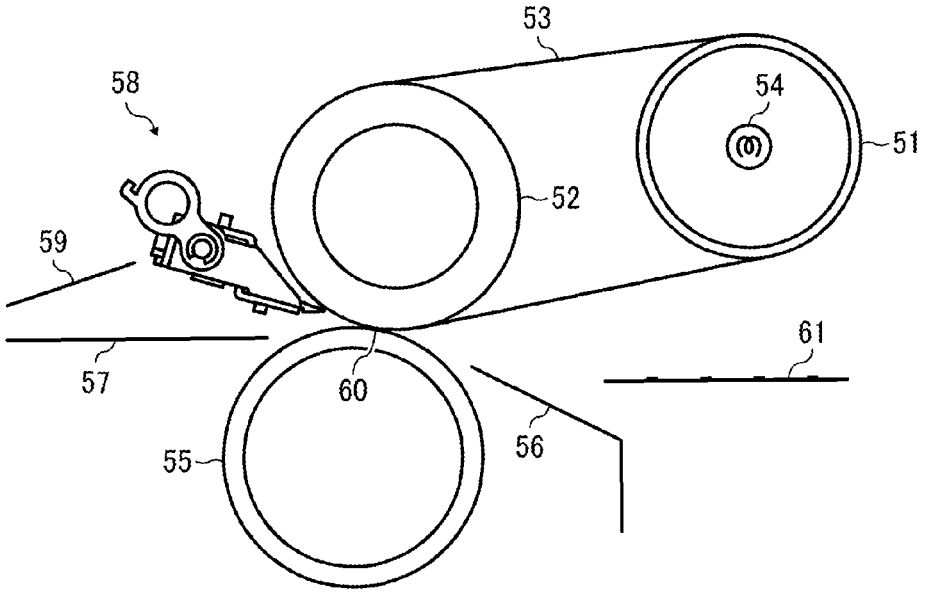
FIG. 1 is a schematic view of one example of a heat fixing device according to an exemplary embodiment of the present invention.

The accompanying drawings are intended to depict embodiments of the present disclosure and should not be interpreted to limit the scope thereof. The accompanying drawings are not to be considered as drawn to scale unless explicitly noted.

DETAILED DESCRIPTION OF EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the invention and all of the components or elements described in the embodiments of this disclosure are not necessarily indispensable to the present invention.

Referring now to the drawings, wherein like reference numerals designate identical or corresponding parts throughout the several views, embodiments of the present disclosure are described below.

FIG. 1 is a schematic view of one example of a heat fixing device according to an exemplary embodiment of the present invention.

In FIG. 1, a fixing device includes a heating roller 51, a fixing roller 52, a fixing belt 53, and a pressure roller 55. The fixing belt 53 is looped around the heating roller 51 and the fixing roller 52. A halogen heater 54 as a heat source is disposed inside the heating roller 51, and a separation unit 58 is attached on a downstream side. The heating roller 51 includes a metal pipe, and the fixing roller 52 includes a metal pipe having a surface on which a silicone rubber layer is provided. The pressure roller 55 also includes a metal pipe having a surface on which a silicone rubber layer is provided. The pressure roller 55 is pressed toward the fixing roller 52 via the fixing belt 53 to form a nipping portion 60. The fixing belt 53, the fixing roller 52, and the heating roller 51 are rotated by rotation of the pressure roller 55 driven by a driving device.

The fixing belt 53 includes a heat-resistant polyimide base, and a silicone rubber layer or a perfluoroalkoxy (PFA) resin layer formed on a surface layer of the polyimide base. Such a configuration suppresses adhesion of melted toner on a recording medium (hereinafter also called a sheet) to the fixing belt 53. The term "recording medium" used herein includes thick paper, a post card, an envelope, thin paper, coated paper (e.g., art paper), tracing paper, and an overhead projector (OHP) sheet in addition to plain paper.

A temperature detection element detects a surface temperature of the fixing belt 53 wound around the heating roller 51. The halogen heater 54 is controlled to be turned on and off such that the temperature measured by the temperature detection element is maintained constant.

A sheet 61 bearing a toner image is conveyed from right to left as illustrated in FIG. 1, and guided to the nipping portion 60 by an entrance guide plate 56. The toner on the sheet 61 is heated and pressed in the nipping portion 60, thereby fixing the toner on the sheet 61. The sheet 61 with the fixed toner image is guided by the separation unit 58, an upper exit guide plate 59, and a lower exit guide plate 57, and discharged.

Since the fixing belt 53 contacts a toner bearing surface of the sheet 61, the sheet 61 is likely to be wound on the fixing belt 53 by adhesion of the toner. Accordingly, at a side at which the fixing belt 53 is disposed, a tip of a separation member of the separation unit 58 is positioned in the immediate vicinity on a downstream side of the nipping portion 60 in a sheet conveyance direction in which the sheet 61 is conveyed. Moreover, the separation unit 58 is adjusted and mounted in the fixing device to have a clearance of approximately 0.3 mm between the tip of the separation member of the separation unit 58 and a circumferential surface of the fixing belt 53. By contrast, adhesion of the toner is not generated at a side at which the pressure roller 55 is disposed, and thus a clearance between the lower exit guide plate 57 made of heat-resistant resin and the pressure roller 55 is set to be approximately 1 mm to approximately 2 mm.

Next, the separation unit 58 with a recording medium separation configuration is described below.

The separation unit 58 is disposed on a downstream side in a sheet/recording medium conveyance direction. The separation unit 58 extends in a longitudinal direction of the heating roller 51, the fixing belt 53, the fixing roller 52, or the pressure roller 55 serving as a rotary body. As illustrated in FIG. 2A through FIG. 4B, the separation unit 58 includes a positioning member 107, a separation plate 110, and a spring attachment member 106 that are mounted on a separation plate holder 101.

Figure 5:
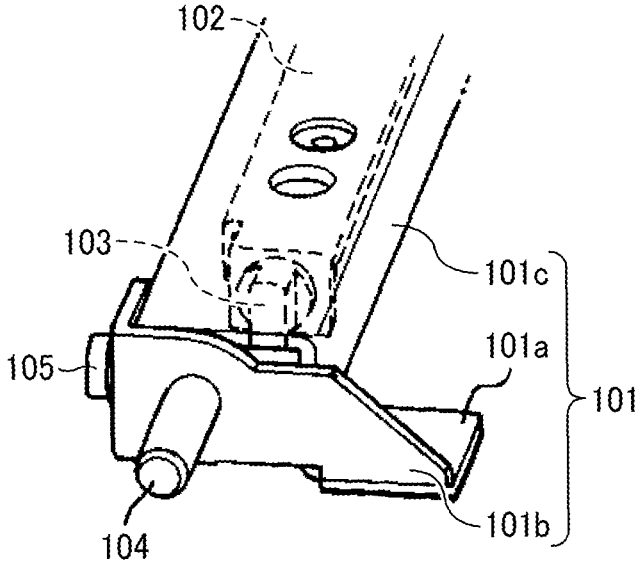
FIG. 5 is a perspective view of an end portion of a separation plate holder.

As partially illustrated in FIG. 5, the separation plate holder 101 has two sides along a longitudinal direction thereof, and the two sides are bent downward at a right angle to form a separation plate holding portion 101*c* having a U-shaped cross section. Thus, the separation plate holder 101 has the separation plate holding portion 101*c* across the longitudinal direction thereof. Both ends of an auxiliary holder 102 in a longitudinal direction are bent, and the bent ends of the auxiliary holder 102 and separation plate support pins 103 are swaged together. The auxiliary holder 102 is welded to a back side of an upper surface of the separation plate holder 101. Since the auxiliary holder 102 is welded to the separation plate holder 101, the separation plate holder 101 can enhance strength thereof. In addition, the separation plate holder 101 has plural female screw portions to fix separation plate adjustment screws 111. On an upper surface of the separation plate holder 101, in the present embodiment, the female screw portions are formed at seven points in the longitudinal direction of the separation plate holder 101.

Moreover, the separation plate holder 101 on a side (hereinafter, also referred to as a front side) toward the fixing nip (nipping portion 60) is further bent at a 90-degree angle in a last mounting process within areas of both ends of the separation plate holding portion 101*c* in a longitudinal direction of the separation plate holding portion 101*c*, thereby forming positioning surfaces 101*a*. On each of the positioning surface 101*a*, a positioning embossment and a female screw portion are formed to mount the positioning member 107.

The positioning surface 101*a* has an extension portion corresponding to a portion outside an end face that is each end of the separation plate holding portion 101*c*. The extension portion is further bent at a 90-degree angle to form a bent flange surface 101*b* such that the bent flange surface 101*b* contacts the end face. That is, the bent flange surface 101*b* is formed by bending one side of the positioning surface 101*a*. A rotation fulcrum pin 104 is swaged to the bent flange surface 101*b*. The positioning surfaces 101*a* are formed on both ends of the separation plate holding portion 101*c* in the longitudinal direction.

Figure 10:
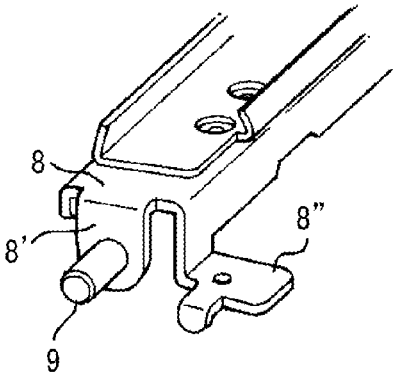
FIG. 10 RELATED ART
FIG. 10 is a perspective view of an end portion of a related-art separation plate holder.

Since the bent flange surface 101*b* serving as a rotation fulcrum surface is formed from the positioning surface 101*a* by a single bending process, higher positional accuracy of the rotation fulcrum and the positioning surface can be obtained than that of the related-art configuration illustrated in FIG. 10.

The bent flange surface 101*b* has an extension portion on a side (hereinafter, also referred to as a back side) opposite to a side toward the fixing nip (nipping portion) 60. The extension portion is further bent at a 90-degree angle in the last mounting process to closely contact a bending surface on a back side of the separation plate holding portion 101*c*. The extension portion of the bent flange surface 101*b* and the bending surface of the separation plate holding portion 101*c* are fastened together with a screw 105. As a result, the positioning surface 101*a*, the bent flange surface 101*b*, the back-side extension portion, the back-side bending surface of the separation plate holding portion 101*c*, the upper surface of the separation plate holding portion 101*c*, a front-side bending surface of the separation plate holding portion 101*c*, and a metal plate surface are coupled, thereby further enhancing strength of the separation plate holder 101. Thus, even in a case where an external force is generated in the separation member due to sheet jam, the separation plate holder 101 is not deformed, and the clearance of the separation plate 110 is accurately maintained. The back-side extension portion and the back-side bending surface of the separation plate holding portion 101*c* may be firmly attached together by a welding process instead of fastening with the screw.

If the positioning surface 101*a* or the rotation fulcrum pin 104 is fixed to a jig beforehand, a small distortion of a part is corrected in a screw-fastening process or welding process, thus further enhancing the positional accuracy of the separation plate holder 101. The separation plate holder 101 manufactured as described above obtains sufficient strength. Accordingly, even if a recording medium is jammed in an accordion shape in the vicinity of the separation unit and a large load is applied to the separation plate holder, the above-described configuration prevents deformation of the separation plate holder 101. Thus, the clearance of the separation plate 110 is not changed by the paper jam.

Moreover, the spring attachment member 106 of the separation unit is fixed to a protruding end of the rotation fulcrum pin 104 such that the spring attachment member 106 does not rotate with respect to the rotation fulcrum pin 104. A spring 115 attached to the spring attachment member 106 urges the separation plate holder 101, that is, the separation unit 58 is urged toward the fixing belt 53 side.

Figure 3A:
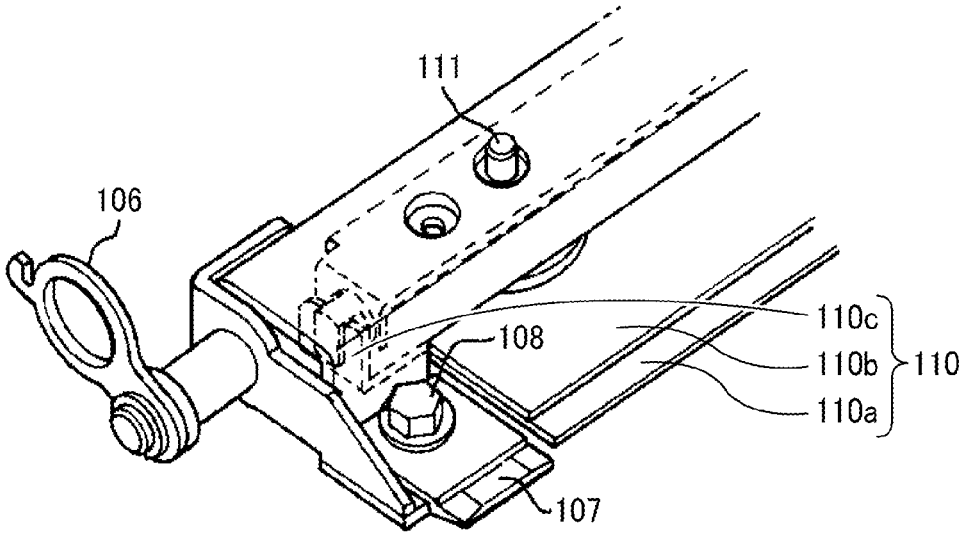
FIG. 3A and FIG. 3B are perspective partial views of a front side of the separation unit as seen at different angels.
Figure 3B:
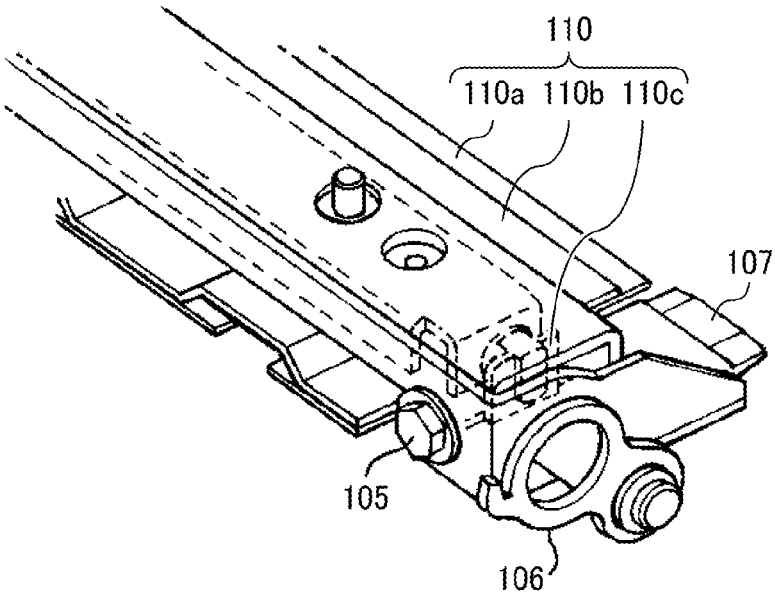

As illustrated in FIG. 3A and FIG. 3B, the positioning member 107 is a plate member, and a protruding edge thereof contacts and slides against the fixing belt 53. The positioning member 107 is mounted on each of the positioning surfaces 101*a* with a screw 108, the positioning surfaces 101*a* being formed on both ends of the separation plate holding portion 101*c* in the longitudinal direction. The positioning member 107 is molded from polyphenylene sulfide (PPS) that is heat-resistance resin. Since the protruding edge of the positioning member 107 contacts the fixing belt 53, a surface layer of the protruding edge is coated with fluorine resin to prevent abrasion of the fixing belt 53.

The separation plate 110 held by the separation plate holder 101 is formed by welding a thin metal plate 110*a* to a base metal plate 110*b*. The separation plate 110 is mounted on the front side of the separation plate holder 101 along the longitudinal direction of the separation plate holder 101, and held in a non-contact manner with respect to the fixing belt 53. The thin metal plate 110*a* has a sheet conveyance surface side that protrudes toward the fixing belt 53 relative to the base metal plate 110*b*. The sheet conveyance surface side of the thin metal plate 110*a* is coated with fluorine resin, and thus the toner on a sheet does not tend to adhere to the sheet conveyance surface side. The thin metal plate 110*a* is a stainless plate having a thickness of approximately 0.3 mm, and such a thickness allows the thin metal plate 110*a* to be arranged in the vicinity of the nipping portion 60.

Figure 2A:
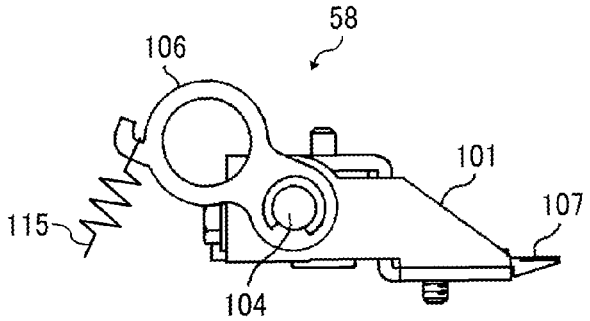
FIG. 2A is a side view of a separation unit as seen from one side thereof.
Figure 2B:
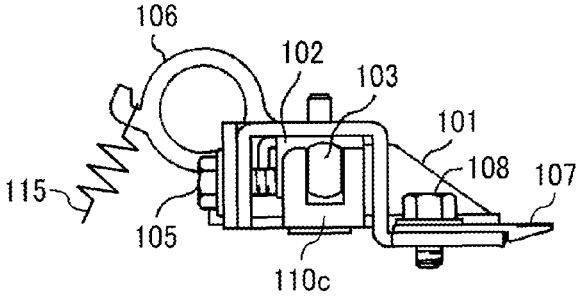
FIG. 2B is a cross-sectional view of the separation unit as seen from the other side thereof.
Figure 4A:
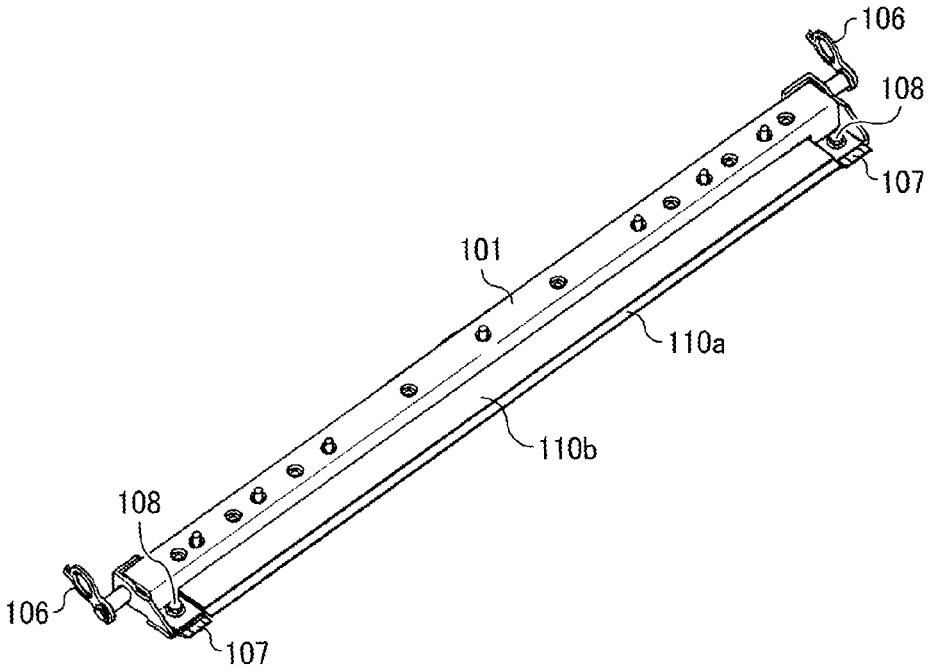
FIG. 4A and FIG. 4B are perspective overall views of the separation unit as seen at different angles.
Figure 4B:
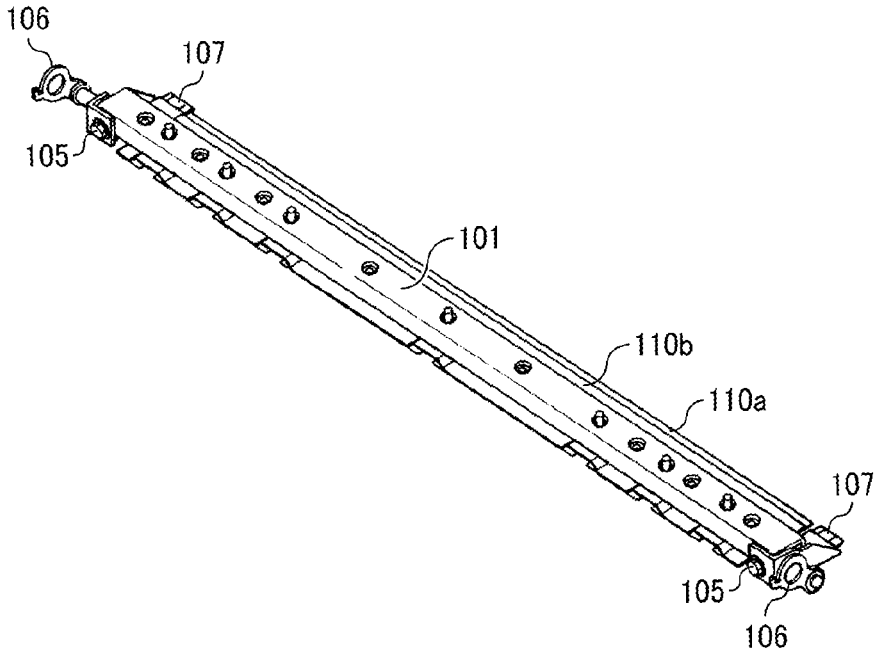

As illustrated in FIG. 2B and FIG. 3A, the base metal plate 110*b* has bent flange surfaces formed on both ends thereof in a longitudinal direction, and a parallel groove 110*c* into which a separation plate support pin 103 having an oval cross-section is fitted. When the separation plate support pin 103 and the parallel groove 110*c* fit together, the thin metal plate 110*a* and the base metal plate 110*b* become movable only in a vertical direction in FIG. 2B. Moreover, as illustrated in FIG. 4A and FIG. 4B, the base metal plate 110*b* has seven round holes in the longitudinal direction thereof. The seven holes are provided for the respective female screw portions formed on the upper surface of the separation plate holder 101 to fix the separation plate adjustment screws 111. Each round hole has a diameter larger than a screw diameter of the screw 111, but smaller than a screw head diameter of the screw 111. The auxiliary holder 102 also has round holes for the respective female screw portions formed on the upper surface of the separation plate holder 101.

Figure 6:
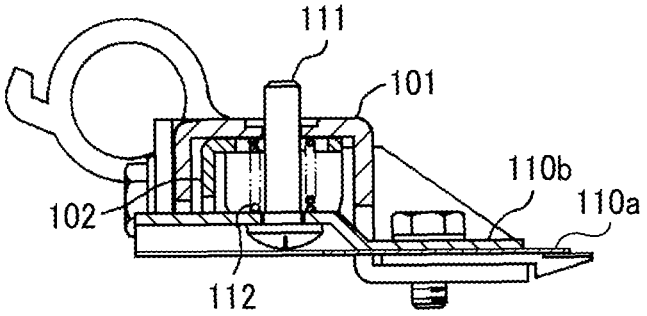
FIG. 6 is a diagram of an adjustment assembly to adjust a separation plate.

FIG. 6 is a cross-sectional diagram of an adjustment assembly to adjust the separation plate holder 101 with the thin metal plate 110*a* and the base metal plate 110*b* with respect to a vertical direction (a direction substantially perpendicular to a sheet conveyance direction).

The screw 111 and a spring 112 are provided between each of the seven round holes on the base metal plate 110*b* and the upper surface of the separation plate holder 101. When the screw 111 in the female screw portion formed on the upper surface of the separation plate holder 101 is tightened, the thin metal plate 110*a* and the base metal plate 110*b* move upward. When the screw 111 is loosened, the base metal plate 110*b* is urged by the spring 112 so as to push a screw head of the screw 111. Such a configuration allows precise adjustment of a clearance between the fixing belt 53 and the separation plate 110.

In the present embodiment, the thin metal plate 110*a* and the base metal plate 110*b* are welded together to form the substantially single separation plate 110 in a longitudinal direction, and the separation plate 110 is held by the separation plate holder 101. However, in some embodiments, a plurality of separation plates in a longitudinal direction may be held by the separation plate holder 101. In the present exemplary embodiment, moreover, the separation plate and the separation plate holder are formed independently and adjustable. However, in an image forming apparatus that can maintain a separation performance thereof even in a case where a separation plate has a wider clearance, the separation plate may be directly mounted on a separation plate holder without an adjustment assembly. Alternatively, the separation plate and the separation plate holder may be integrally formed as a single plate.

Figure 7:
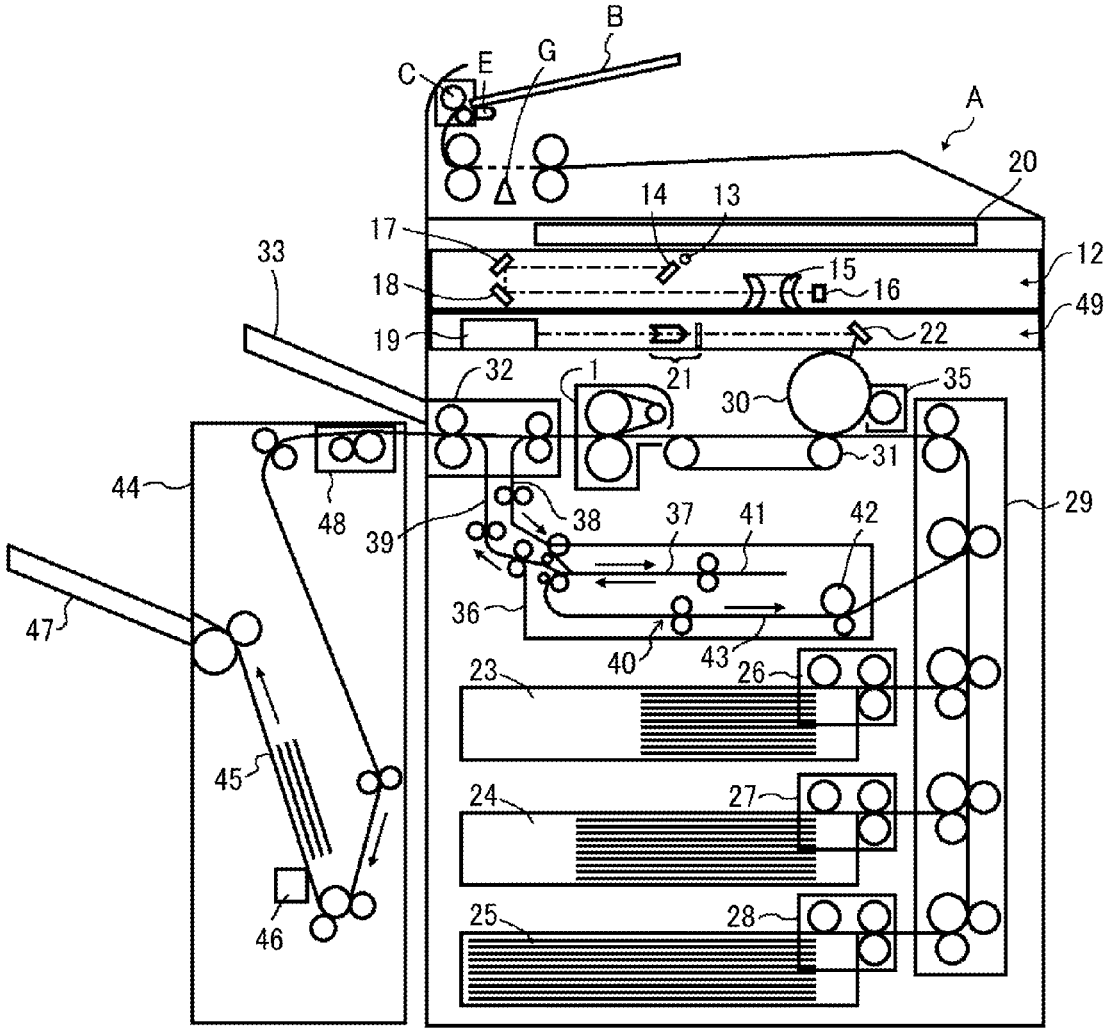
FIG. 7 is a schematic diagram of an image forming apparatus employing a fixing device according to an exemplary embodiment of the present invention.
Figure 8:
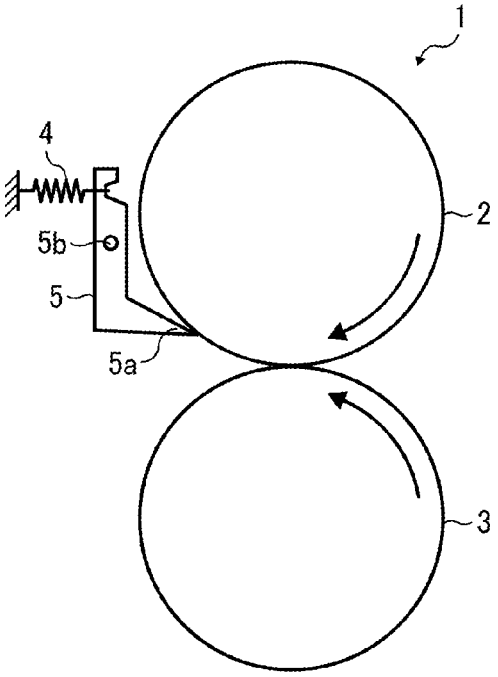
FIG. 8 RELATED ART
FIG. 8 is a schematic diagram of one example of a related-art separation unit.
Figure 9:
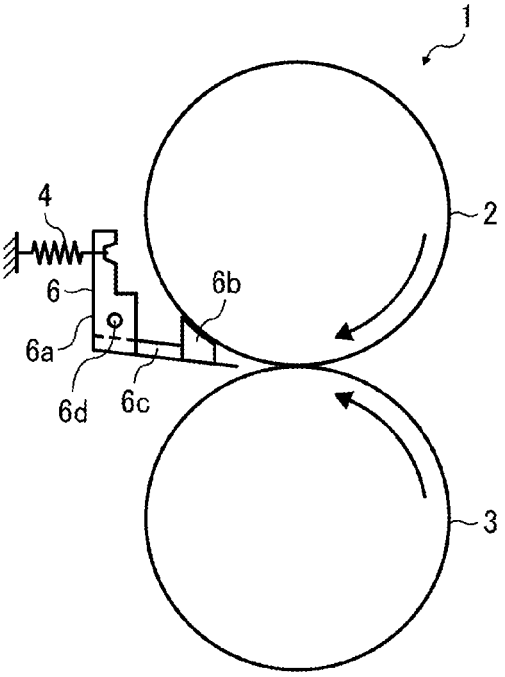
FIG. 9 RELATED ART
FIG. 9 is a schematic diagram of another example of a related-art separation unit.

FIG. 7 is a schematic diagram of an image forming apparatus employing the fixing device described above, according to an exemplary embodiment of this invention.

In FIG. 7, a reading unit 12 is disposed to scan an original document placed on a pressure plate. The reading unit 12 includes an exposure glass 20 on which the original document is placed, and an optical scanning system. The optical scanning system includes an exposure lamp 13, a first mirror 14, a second mirror 17, a third mirror 18, a lens 15, and a charge-coupled device (CCD) image sensor 16. The CCD image sensor 16 reads an original image, and converts the read image into electric signals, so that the electric signals are processed.

The image forming apparatus illustrated in FIG. 7 includes an automatic document reading device A for automatically reading a sheet of an original document. In the automatic document reading device A, an original document placed on a document tray B is fed to a position of a document reading sensor G by a feeding roller C. The document reading sensor G reads an image on a front surface of the original document when the document passes the original document reading sensor G at a constant speed. The image data read by the document reading sensor G undergoes an image process (e.g., various corrections, and compression), and then is sequentially stored in an image memory.

A writing unit 49 includes a laser output unit 19, an imaging lens 21, and a mirror 22. The writing unit 49 irradiates a photoconductor 30 of an image forming system with a laser beam.

Next, a procedure for printing an image formed on the photoconductor 30 is briefly described below.

Sheets of paper stacked on any of a first tray 23, a second tray 24, and a third tray 25 are fed by a first feeding device 26, a second feeding device 27, and a third feeding device 28, respectively. Subsequently, each of the sheets is conveyed to a position just short of the photoconductor 30 by a vertical conveyance unit 29.

The writing unit 49 emits a laser beam to the photoconductor 30 based on the image data stored in the image memory to write an image on the photoconductor 30, and the image written on the photoconductor 30 is formed as a toner image by passing a development unit 35. The toner image on the photoconductor 30 is transferred to a sheet while the sheet is being conveyed by a conveyance belt 31 at substantially the same speed as the rotation of the photoconductor 30 in synchronization with movement of the toner image on the photoconductor 30. Subsequently, the fixing device 1 fixes the toner image on the sheet, and a discharge unit 32 discharges the resultant sheet to a discharge tray 33.

In a case where the image forming apparatus forms images on two sides of a sheet, the sheet is fed from any of the first, second, and third trays 23, 24, 25, and an image is formed on a first side of the sheet. Then, a reverse path switching tab switches a conveyance direction of the sheet. The reverse path switching tab allows the sheet to be conveyed to a two-side inlet conveyance path 38 instead of guiding the sheet to the discharge tray 33 side. The sheet conveyed to the two-side inlet conveyance path 38 is guided to a reverse unit 37 disposed inside a two-side conveyance unit 36, and temporarily stored in a switchback conveyance path 41. Subsequently, the sheet is fed in reverse (in a re-feeding direction) by a return conveyance unit. The sheet is then guided downward and reversed by a reverse discharge switching tab. The reversed sheet is fed to a two-side intermediate conveyance path 43 that is arranged below the reverse discharge switching tab. The sheet is again conveyed to the vertical conveyance unit 29 by an intermediate conveyance unit 40 connected to a drive source (a motor) and a two-side outlet conveyance unit 42, so that an image is printed on a second side of the sheet. The sheet is discharged after the image is printed on the second side.

In a case where the image forming apparatus discharges a reversed sheet, the sheet is switched back and reversed by the reverse unit 37, and then fed to a reverse discharge conveyance path 39 by the reverse discharge switching tab without passing the two-side intermediate conveyance path 43. Subsequently, the sheet returns to the discharge unit 32 again, and is discharged outside an apparatus body of the image forming apparatus.

The sheet is discharged from the apparatus body to either the discharge tray 33 of the apparatus body or a finisher 44 by a sheet discharge destination switching tab. If the sheet is discharged to the finisher 44, the sheet passes a punch unit 48 for punching a hole, and is once stacked on a sheet stacking tray 45 to undergo a staple process.

After all the sheets in a bundle are stacked on the sheet stacking tray 45, the sheet bundle is stapled together by a stapler unit 46, and the stapled bundle is discharged to a discharge tray 47.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device, comprising:

two rotary bodies pressed against each other to form a nipping portion through which a recording medium is conveyed; and a recording-medium separation unit disposed at a position downstream from the nipping portion in a recording-medium conveyance direction in which the recording medium is conveyed, the recording-medium separation unit including a separation plate holder, a separation plate, and a spring, the separation plate holder extending in a longitudinal direction of one of the rotary bodies to hold the separation plate away from the one of the rotary bodies;

the separation plate holder having rotation fulcrums and positioning surfaces at both ends in the longitudinal direction, the positioning surfaces of the separation plate holder urged by the spring toward the one of the rotary bodies, each of the positioning surfaces having a 90° bent flange surface, and including one of the rotation fulcrums, wherein the separation plate holder has two sides along a longitudinal direction thereof, and the two sides are bent downward at a right angle to form a separation plate holding portion.

2. The fixing device according to claim 1, wherein the flange surface has a bent surface firmly attached to a back side of the separation plate holder, and the back side of the separation plate is disposed at a side opposite the positioning surface relative to the one of the rotary bodies.

3. The fixing device according to claim 1, further comprising an adjustment assembly to adjust a position of the separation plate in a direction perpendicular to the recording-medium conveyance direction with respect to the separation plate holder.

4. The fixing device according to claim 1, wherein the separation plate holder includes heat-resistant positioning members to slidingly contact the one of the rotary bodies, and the heat-resistant positioning members are mounted on the positioning surfaces.

5. The fixing device according to claim 4, wherein each of the heat-resistant positioning members has a surface layer formed of heat-resistant resin and coated with fluorine resin.

6. An image forming apparatus comprising the fixing device according to claim 1.

7. The fixing device according to claim 1, wherein the separation plate holding portion has a U-shaped cross section.

8. The fixing device according to claim 1, wherein the positioning surfaces include an extension portion corresponding to a portion outside an end face of the separation plate holding portion.

9. The fixing device according to claim 1, wherein the bent flange surface has an extension portion on a back side opposite to a side toward the nipping portion.

10. The fixing device according to claim 9, wherein the extension portion is further bent at 90° to closely contact a bending surface on a back side of the separation plate holding portion.

11. The fixing device according to claim 9, wherein the extension portion of the bent flange surface and the bending surface of the separation plate holding portion are held together.

12. The fixing device according to claim 11, wherein the extension portion of the bent flange surface and the bending surface of the separation plate holding portion are fastened together with a screw.

13. The fixing device according to claim 1, further comprising an auxiliary holder in a longitudinal direction of the separation plate holder.

14. The fixing device according to claim 13, wherein the auxiliary holder is welded to a back side of an upper surface of the separation plate holder.

15. The fixing device according to claim 13, wherein both ends of the auxiliary holder in the longitudinal direction are bent.

* * * * *